United States Patent [19]

Fischer et al.

[11] Patent Number: 4,764,255

[45] Date of Patent: Aug. 16, 1988

[54] CEMENTED CARBIDE TOOL

[75] Inventors: Udo K. Fischer, Vallingby; Erik T. Hartzell, Alvsjo; Mats G. Waldenstrom, Bromma, all of Sweden

[73] Assignee: Sandvik AB, Sandviken, Sweden

[21] Appl. No.: 25,629

[22] Filed: Mar. 13, 1987

[51] Int. Cl.[4] ..... E21B 10/46

[52] U.S. Cl. ..... 175/329; 175/410

[58] Field of Search ..... 175/329, 409, 410; 164/98, 100, 102

[56] References Cited

U.S. PATENT DOCUMENTS

| | | | |
|---|---|---|---|
| 2,743,495 | 5/1956 | Eklund . | |
| 3,225,400 | 12/1965 | Buschow | 164/102 |
| 3,693,736 | 9/1972 | Gardner | 175/410 |
| 3,852,874 | 12/1974 | Pearson | 175/410 X |
| 3,888,297 | 6/1975 | Davies | 164/100 |
| 4,119,459 | 10/1978 | Ekemar et al. . | |
| 4,339,009 | 7/1982 | Busby | 175/410 X |
| 4,553,615 | 11/1985 | Grainger | 175/410 X |
| 4,584,020 | 4/1986 | Waldenstrom . | |
| 4,627,503 | 12/1986 | Horton | 175/410 X |
| 4,676,124 | 6/1987 | Fischer | 175/410 X |

FOREIGN PATENT DOCUMENTS

| | | | |
|---|---|---|---|
| 203122 | of 1956 | Australia | 175/410 |
| 183787 | of 1963 | Sweden | 175/410 |
| 664983 | of 1950 | United Kingdom | 175/410 |

*Primary Examiner*—Stephen J. Novosad
*Assistant Examiner*—William P. Neuder
*Attorney, Agent, or Firm*—Burns, Doane, Swecker & Mathis

[57] ABSTRACT

A tool or wear part comprises a cast iron or cast steel body carrying a plurality of cast-in inserts. Each insert comprises a cemented carbide cutting or wearing element partially embedded in the body, and an enclosure completely surrounding the embedded portion of the element. The enclosure is cast-in with respect to the body and has a higher melting point than the body. The enclosure is connected by a metallurgical bond to the body and by a shrink-fit to the element.

4 Claims, 1 Drawing Sheet

CEMENTED CARBIDE TOOL

BACKGROUND OF THE INVENTION

The present invention relates to cemented carbide tools, in particular, to tools for drilling of rock and other minerals but it is also applicable to other cemented carbide cutting tools and wear parts.

When casting-in cemented carbide parts in iron alloys such as steel and cast iron the cemented carbide parts are exposed to complex residual stresses due to the essentially lower thermal expansion of the cemented carbide than that of the iron base material. This has no negative influence on the performance of the product as long as the cemented carbide part is completely embedded in the matrix such as disclosed in U.S. Pat. No. 4,119,459 assigned to the same assignee as the present application. However, when the cemented carbide body has a certain protrusion from the matrix the complex tensions in the transition matrix-free cemented carbide part lead to an unacceptable decrease of strength. Another great disadvantage from a strength point of view is that, in addition, a brittle transition zone is formed due to dissolution of iron in the surface zone of the cemented carbide.

Thus, the above-mentioned two factors result in great limitations on the casting technique, in particular, for products requiring a certain protrusion of the cemented carbide such as buttons or inserts in rock drill bits. For such products today, conventional methods of fastening have to be used (brazing, pressing etc.). These methods result in high costs due to the necessity of precision manufacturing (boring-grinding).

SUMMARY OF THE INVENTION

It is an object of the present invention to avoid or alleviate the problems of the prior art.

The disadvantages described above can be avoided by protecting the cemented carbide part during the casting operation according to the following:

The cemented carbide part is provided with a cup of steel or similar suitable alloy. The cemented carbide part with the cup is placed in the mould. At the subsequent casting a good metallurgical bond is obtained between the cup and the cast alloy and simultaneously a good shrink fit between the cup and the cemented carbide part is obtained. The cemented carbide part never comes in contact with the melt and, thus, the above-mentioned brittle transition zone is never formed.

In a preferred embodiment of the invention the cemented carbide art protrudes above the surface of the cast iron. Said protrusion shall be at least 10% and preferably at least 20% of the height of the cemented carbide part.

THE DRAWING

The FIGURE shows a cross-sectional view through a tool according to the present invention.

DETAILED DESCRIPTION OF A PREFERRED EMBODIMENT OF THE INVENTION

Figure 1:
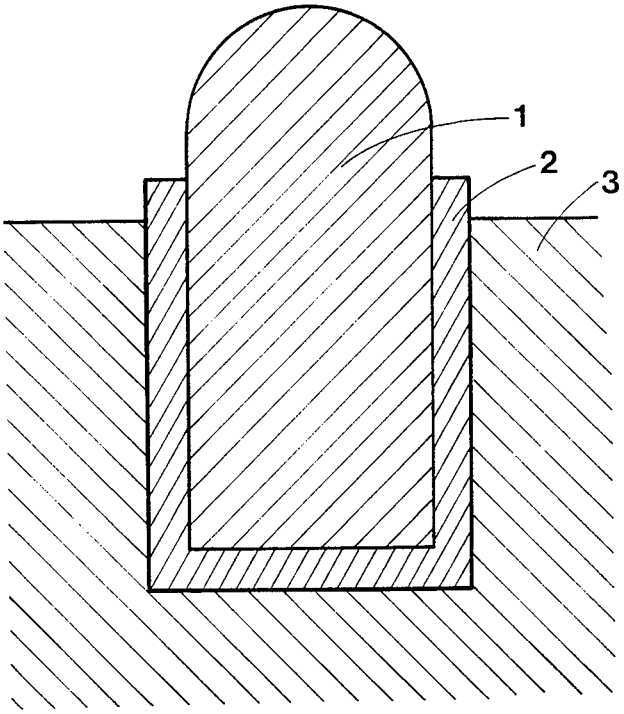

In the FIGURE 1 is the cemented carbide insert, 2 is the cup and 3 is cast iron or steel.

The material of the cup is chosen in such a way that its melting point is higher, at least 50° C. preferably 200°–400° C. above the melting point of the cast alloy of the tool body. When an essentially graphitic cast iron is used for the tool body, a low carbon steel has turned out to be a suitable cup material. Generally the carbon content of the steel cup is 0.2% at most.

The wall of the cup should be so thick that it protects the cemented carbide part during the casting. However, it must also be thin enough to allow a certain deformation during the cooling in order to further fasten the cemented carbide body in the cast iron body. A wall thickness of 0.5–10 mm preferably 1–5 mm is suitable in most cases.

It is important that the cup protrudes somewhat above the surface of the cast iron in order to protect the 'corner' cemented carbide-cast iron where the notch effect is particularly severe. A protrusion of at least 1 mm is sufficient in most cases.

The steel cup is generally cylindrical but other shapes are also possible. To further decrease the residual stresses the cup can be chamfered towards the inside.

The joint can be compared with conventional shrink joints as regards strength and residual stresses. It is strong enough to withstand the impacts occurring in heavy wear applications.

As mentioned, the invention is particularly applicable to rock drill applications. For oil well drill bit cutting, elements of diamond and/or cubic boron nitride are often used.

In tools or wear parts according to the invention, the cast iron part exposed to wear is advantageously provided with a surface layer in which cemented carbide particles are dispersed e.g. according to U.S. Pat. No. 4,119,459. The thickness of said layer should be less than 10 mm preferably 5–7 mm.

The following examples illustrate the invention in rock drilling applications.

EXAMPLE 1

In order to lower the cost when producing button bits, attempts were made with the casting technique. The buttons were cast in the drill according to the invention, i.e., with a low carbon steel cup (0.05% C) and without cup in the conventional way.

| | |
|---|---|
| Drill bit: | ø 178 mm DTH (= Down-The-Hole-bit) low alloyed steel with 0.6% C |
| Cemented carbide button | 6% Co, 94% WC ø 16 mm, height 30 mm, protrusion 8 mm. |
| Machine | Ingersoll Rand |
| Rock | Granite |
| Variant 1 | Standard bit with bored shrink fitted buttons |
| Variant 2 | Bit according to the invention |
| Variant 3 | Bit with buttons without cup. |

Result:

| Variant | Life, drilled meters |
|---|---|
| 1 | 560 m worn out button |
| 2 | 568 m worn out button |
| 3 | 5 m button failure |

EXAMPLE 2

In order to improve the erosion resistance of oil well drill bits of PDC-type such bits were manufactured of nodular iron with cemented carbide particles in the surface layer (U.S. Pat. No. 4,119,459) and studs according to the invention.

| | |
|---|---|
| Drill bit: | ø 216 mm, Fish Tail bit |

-continued

| | |
|---|---|
| PDC-stud: | Ø 17.5 mm, height 33 mm, protrusion 15 mm |

The test was performed in a laboratory rig in order to test the strength of the cemented carbide stud. The drilling was performed in granite in order to enhance the strain.

| | |
|---|---|
| Variant 1 | PDC drill bit of standard type with shrink fitted cemented carbide studs |
| Variant 2 | PDC bit according to the invention |
| Variant 3 | PDC bit with cast in cemented carbide studs without cup. |
| Data: | |
| Load | 10, 20, 30, 40 tons |
| Penetration rate | 1 mm/ rev |
| Number of revolutions | 70 rpm |
| Cemented carbide grade | 15% Co, 85% WC |
| Result | Variants 1 and 2 withstood the load of 10–40 tons<br>Variant 3 was damaged already at 10 tons. |

We claim:

1. Cemented carbide tool or wear part comprising a cast iron or cast steel body carrying a plurality of cast-in inserts, each said insert comprising:

a cutting or wearing element of cemented carbide including an embedded portion extending into said body and a projecting portion extending beyond said body, and an enclosure cast-in with respect to said body and completely surrounding said embedded portion, said enclosure comprising a material having a higher melting point than said body and connected by a metallurgical bond to said body and by a shrink fit to said element.

2. Cemented carbide tool or wear part according to claim 1 in which the wall thickness of the enclosure is 0.5–10 mm and the melting point of the enclosure is more than 50° C. above the melting point of the body.

3. Cemented carbide tool or wear part according to claim 1 in which a surface of the body exposed to wear has thereon a layer with a thickness of less than 10 mm in which cemented carbide particles are dispersed.

4. Cemented carbide tool or wear part according to claim 1, wherein said tool or wear part comprises a rotary drill bit, said cutting or wearing element comprising a cutting button with a diamond layer.

* * * * *